US006655313B1

(12) United States Patent
Woodall et al.

(10) Patent No.: US 6,655,313 B1
(45) Date of Patent: Dec. 2, 2003

(54) COLLAPSIBLE WET OR DRY SUBMERSIBLE VEHICLE

(75) Inventors: Robert Woodall, Panama City Beach, FL (US); Felipe Garcia, Panama City, FL (US); Robert Schoeni, Panama City Beach, FL (US); Frank Skerratt, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/196,385

(22) Filed: Jul. 12, 2002

(51) Int. Cl.[7] ..... B63G 8/00

(52) U.S. Cl. ..... 114/312; 244/3.15; 244/120

(58) Field of Search ..... 114/312, 331, 114/21.2; 244/3.15, 120

(56) References Cited

U.S. PATENT DOCUMENTS

| | | | | | |
|---|---|---|---|---|---|
| 5,522,337 | A | * | 6/1996 | Meyers et al. | 114/312 |
| 5,686,694 | A | * | 11/1997 | Hillenbrand et al. | 114/21.2 |
| 6,056,237 | A | * | 5/2000 | Woodland | 244/3.15 |
| 6,082,675 | A | * | 7/2000 | Woodall et al. | 244/120 |
| 6,293,202 | B1 | * | 9/2001 | Woodall et al. | 244/14 |

* cited by examiner

*Primary Examiner*—S. Joseph Morano
*Assistant Examiner*—Lars A. Olson
(74) *Attorney, Agent, or Firm*—Harvey A. Gilbert; Donald G. Peck

(57) ABSTRACT

A submersible vehicle's hull has an outer wall that is at least partially constructed of a multi-wall fabric having a sealed space between at least two walls thereof. The sealed space is controllably filled with one of air, water, and a combination of air and water in order to control the buoyancy of the hull formed from the multi-wall fabric. Means are provided for propelling and steering the hull in the water. The interior volume of the hull can remain dry or can be filled with water for a wet mode of operation.

22 Claims, 5 Drawing Sheets

COLLAPSIBLE WET OR DRY SUBMERSIBLE VEHICLE

ORIGIN OF THE INVENTION

The invention described herein was made in the performance of official duties by employees of the Department of the Navy and may be manufactured, used, licensed by or for the Government for any governmental purpose without payment of any royalties thereon.

Field of the Invention

The invention relates generally to submersible vehicles, and more particularly to a submersible vehicle having a hull that is substantially or completely collapsible and that can be used as a wet or dry submersible vehicle.

Background of the Invention

Manned submersible vehicles are used in a variety of naval and civilian activities. "Dry" submersible vehicles are constructed to keep water out of the various operator compartments whereas "wet" submersible vehicles must be piloted by scuba-equipped operators as the vehicle is allowed to fill with water during the submerging thereof. Dry submersible vehicles are generally large and are designed for long underwater missions. Wet submersible vehicles provide a number of advantages when compared to dry submersible vehicles. For example, wet submersibles are neutrally buoyant and, therefore, require less power than a comparably-sized dry submersible which needs a greater amount of propulsion power to overcome the vehicle's inherent buoyancy. Thus, wet submersible vehicles can be smaller thereby making them more maneuverable in shallow and/or obstacle-laden water environments. Further, wet submersibles are ideal for search and rescue missions since the operators thereof are already outfitted with scuba gear and can quickly exit the vehicle when needed. Currently, submersible vehicles are designed to be either "wet " or "dry". However, there is no submersible. vehicle designed to be operated in both wet and/or dry modes.

The problems associated with existing wet and dry submersible vehicle designs include: i) substantial weight requiring larger propulsion and steering systems, ii) a rigid constant shape that prevents their stowage in a smaller, logistically desirable volume for transportation and storage, and iii) their inability to adapt to either a wet or dry submersible stat us.

SUMMARY OF THE INVENTION

Accordingly, it is an object of the present invention to provide an improved submersible vehicle.

Another object of the present invention is to provide a submersible vehicle design that will be of loser weight when compared to comparably-sized existing submersible vehicles.

Still another object of the present invention is to provide a submersible vehicle that can be collapsed to a smaller volume for transportation and storage.

Yet another object of t he present invention is to provide a submersible vehicle that can be used as either a wet or dry submersible vehicle.

A still further object of the present invention is to provide a submersible vehicle having both wet and dry submersible portions.

Other objects and advantages of the present invention will become more obvious hereinafter in the specification and drawings.

In accordance with the present invention, a submersible vehicle has a hull having a forward end and an aft end. The hull has an outer wall that is at least partially constructed of a multi-wall fabric having a sealed space between at least two walls thereof. The sealed space is controllably filled with one of air, water, and a combination of air and water in order to control the buoyancy of the hull formed from the multi-wall fabric. Means are provided for propelling and steering the hull in the water. The interior volume of the hull can remain dry or can be filled with water for a wet mode of operation.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
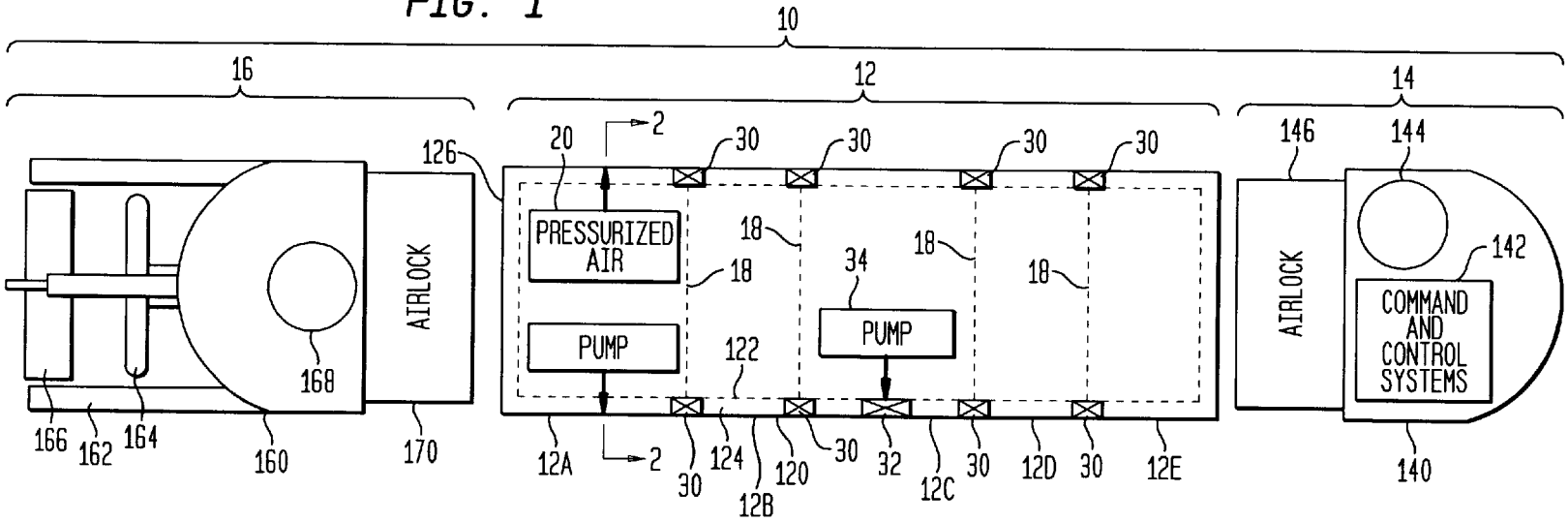
FIG. 1 is an exploded schematic view of a collapsible submersible vehicle in accordance with an embodiment of the present invention.

Referring now to the drawings, and more particularly to FIG. 1, an embodiment of the collapsible submersible vehicle of the present invention is shown in exploded form and is referenced generally by numeral 10. In the illustrated embodiment, submersible vehicle 10 has the following three main assemblies: a collapsible hull assembly 12, a nose assembly 14, and a tail assembly 16. However, it is to be understood that the present invention is not limited to this construction. Accordingly, the scope of the present invention should be considered in light of a variety of alternative embodiments and/or additional features that will be discussed further below.

Collapsible hull assembly 12 is constructed as a plurality of coupled sections such as sections 12A–12E. Each of sections 12A–12E defines an exterior shape and interior shaped volume so that a continuous volume is defined within hull assembly 12. The particular outer shape or inner volumetric shape of each of sections 12A–12E is not a limitation of the present invention. For example, each of sections 12A–12E could define an outer shape and inner volumetric shape that is cylindrical, rectangular, triangular, octagonal, etc. Further, each section can have the same shape or a different shape. In this way, the overall inner volumetric shape and outer shape of hull assembly 12 can be tailored for a specific application.

As mentioned above, the inner volume of hull assembly 12 can be continuous or could alternatively be divided up into compartments using bulkheads. For example, vertical dashed lines 18 (indicative of the divisions between adjoining ones of sections 12A–12E in the illustrated example) could also be indicative of bulkheads. Note that the number of bulkheads and their position in hull assembly 12 is not a limitation of the present invention.

Each of sections 12A–12E is constructed in a similar fashion. Accordingly, a description of section 12A applies equally to each of the remaining sections. In describing section 12A, simultaneous reference will be made to FIG. 2 which is a cross-sectional view of section 12A taken along line 2—2 in FIG. 1.

Figure 2:
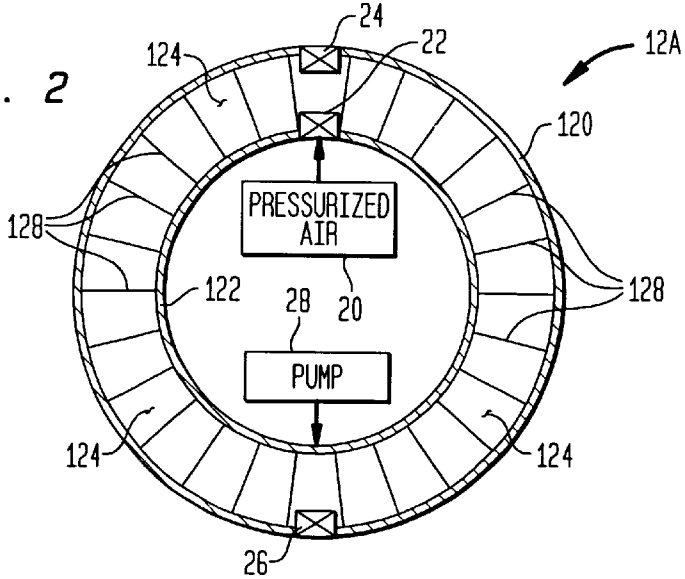
FIG. 2 is a cross-sectional view of one of the hull assembly's inflatable sections taken along line 2—2 of FIG. 1.

Section 12A defines an outer wall structure made from an inflatable multi-wall fabric that encloses a shaped volume. For example, as shown in FIG. 2, an exterior wall 120 is formed from at least one sheet of flexible airtight and watertight material(s). Similarly, an interior wall 122 is formed from one or more flexible airtight and watertight material (s). Walls 120 and 122 are spaced apart from one another to define a sealed space 124 therebetween. Note that the fore and aft ends of section 12A (e.g., end 126 in FIG. 1) are sealed using the same materials used for walls 120, 122. Walls 120 and 122 are connected to one another by a plurality of flexible ties or links 128 which can be threads chosen from any of a plethora of well known strength materials. Links 128 hold walls 120, 122 in their connected relationship when sealed space 124 is filled/pressurized with one of air, water or a combination of air and water as will be explained further below. For underwater usage, it is desirable that the materials used for walls 120, 122 and links 128 be both strong and resistant to abrasion damage. Accordingly, KEVLAR or similar materials are preferred.

A variety of sealed fabric construction techniques can be used to make section 12A. Some examples include the techniques disclosed in each of U.S. Pat. Nos. 2,912,033, 4,462,331 and 5,868,095. As noted above, each of walls 120, 122 can be realized by a single fabric layer or multiple material layers. In a multi-layer wall construction, one layer can be a viscous polymeric sealing gel that automatically seals any punctures. Examples of sealing layers and material formulations thereof are described in U.S. Pat. Nos. 4,501,035 and 5,295,525, respectively.

Prior to the filling/pressurization of sealed space 124, walls 120, 122 and links 128 form a compliant outer wall structure that is collapsible. However, once sealed space 124 is filled/pressurized with air, water or a combination of air and water, section 12A assumes its inflated shape shown in FIG. 2. The selective filling/pressurization of sealed space 124 controls the buoyancy of section 12A. To fill some or all of sealed space 124 with air, a tank or other source of pressurized air 20 is coupled to sealed space 124 via a valve 22. Valve 22 can be installed using one wall 122 or both walls 120, 122 as described in U.S. Pat. No. 6,074,261. To purge air from sealed space 124, a second valve 24 is provided in exterior wall 120. Valve 24 can be controllable to vent sealed space 124 as needed. Valve 24 could also incorporate a pressure relief feature to prevent over inflation of sealed space 124. Furthermore, valve 24 could be equipped with a diffuser so that air exiting same generates only tiny bubbles that would not be detectable at the water's surface.

To fill some or all of sealed space 124 with water, a valve 26 is provided to allow a flow of water into and out of sealed space 124. To purge water from sealed space 124, it may be necessary to provide a pump 28 coupled to valve 26. If necessary, pump 28 can be reversible pump to draw water into sealed space 124 as well as pump it therefrom.

Sealed space 124 is filled/pressurized with air, water or a combination of air and water. The filling/pressurization of sealed space 124 inflates and shapes sections 12A. At the same time, the air, water or combination of air and water in sealed space 124 determines the buoyancy of section 12A. Since each of the remaining sections 12B–12E is similarly equipped for their individual inflation and buoyancy control, hull assembly 12 can be floated, submerged and trimmed by controlling the buoyancy of each of sections 12A–12E.

In addition to the valves in each of sections 12A–12E, additional valves 30 can be provided between the sealed spaces of adjoining ones of sections 12A–12E. Thus, control of valves 30 can allow two or more of sections 12A–12E to function as a single section. However, should a problem develop in one section, that section can be isolated by the closing of appropriate ones of valves 30. Individually controlled pumps (not shown) can be provided in conjunction with each of valves 30 to control a direction of flow of air, water or a combination of air and water, between adjoining sealed spaces.

The interior volume of hull assembly 12 can be maintained dry (i.e. air filled) or can be flooded to allow submersible vehicle 10 to operate as a wet submersible. Accordingly, a hull filling valve 32 can be provided to permit water to flow into or out of the volume defined by hull assembly 12. A pump 34 can be coupled to valve 32 to facilitate pumping of water out of hull assembly 12.

Coupled to the forward end of hull assembly 12 is nose assembly 14 defined by a rigid outer shell 140 that can be constructed in any one of a variety of ways known to those skilled in the art. The coupling of hull assembly 12 to nose assembly 14 can be accomplished in a variety of mechanical fashions without departing from the scope of the present invention. Housed within outer shell 140 are systems (e.g., steering and throttle controls, navigation systems, communication systems, etc.) referred to generally herein as command and control systems 142 that are used by onboard personnel to drive submersible vehicle 10. Also, an ingress/egress hatch 144 is typically provided in outer shell 140 to allow personnel to enter/exit submersible vehicle 10. The interior compartment defined by nose assembly 14 can be maintained as a wet or dry compartment. If it is desirable to keep the interior of nose assembly 14 dry at all times, an airlock 146 can be provided so that personnel can leave or enter a wet hull assembly 12.

Coupled to the aft end of hull assembly 12 is tail assembly 16 that can also be constructed in any one of a variety of ways known to those skilled in the art. In general, tail assembly 16 includes a rigid outer shell 160 typically having a propulsion system 162 that includes a propeller 164 and control surfaces 166 with command and control systems 142 being coupled thereto via wires (not shown for clarity of the-illustration) for control thereof. The interior compartment defined by tail assembly 16 can be maintained as a wet or dry compartment. An additional (or alternative) ingress/egress hatch 168 and airlock 170 can also be provided in tail assembly 16.

Figure 3:
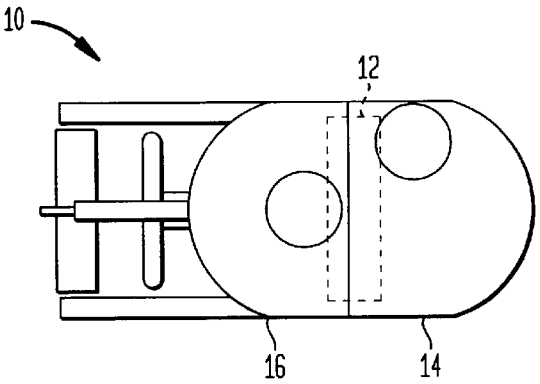
FIG. 3 is a side view of the submersible vehicle in its deflated state with the collapsed hull assembly folded and captured between joined nose and tail assemblies.

Prior to deployment of submersible vehicle 10, hull assembly 12 is in its deflated (compliant) state without air or water filling/pressurizing sealed space 124. In this compliant state, hull assembly 12 can be collapsed (e.g., rolled, folded in an accordion fashion, etc.) so that nose assembly 14 and tail assembly 16 can be drawn together as shown in FIG. 3 where a collapsed hull assembly 12 is fitted in and between nose assembly 14 and tail assembly 16 which are joined or latched together in a mechanical fashion.

Figure 4:
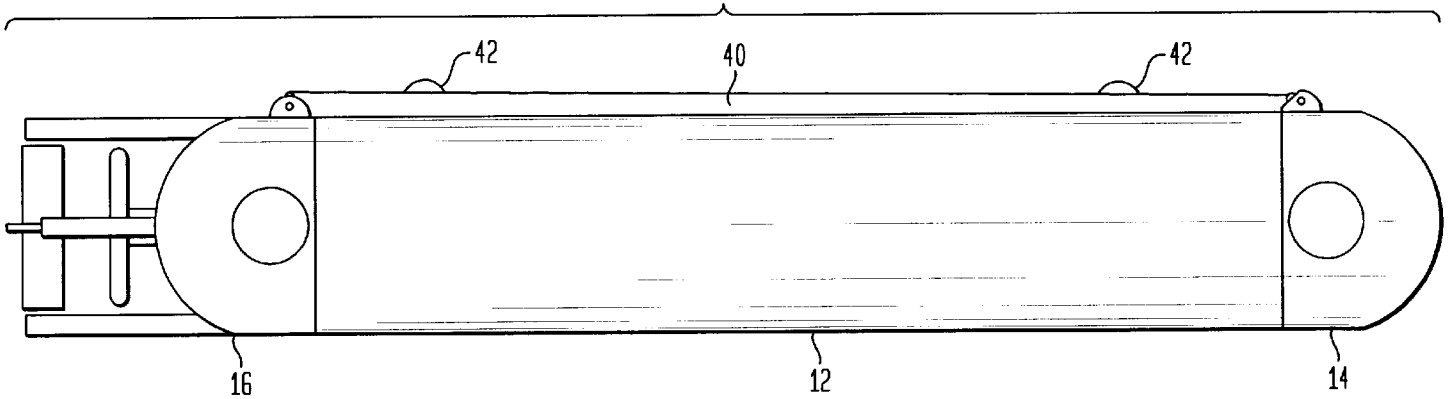
FIG. 4 is a side view of the submersible vehicle in its inflated state having a boom coupling the nose and tail assemblies.

After deployment and inflation of submersible vehicle 10, it will appear as illustrated in FIG. 4 where hull assembly 12 is inflated (as described above) with air, water, or a combination thereof. When submersible vehicle 10 completes its mission, it may be necessary to retrieve/lift it out of the water. To facilitate such lifting, a boom 40 can be rigidly coupled to each of nose assembly 14 and tail assembly 16. Hoisting points 42 can be provided on boom 40.

Figure 5:
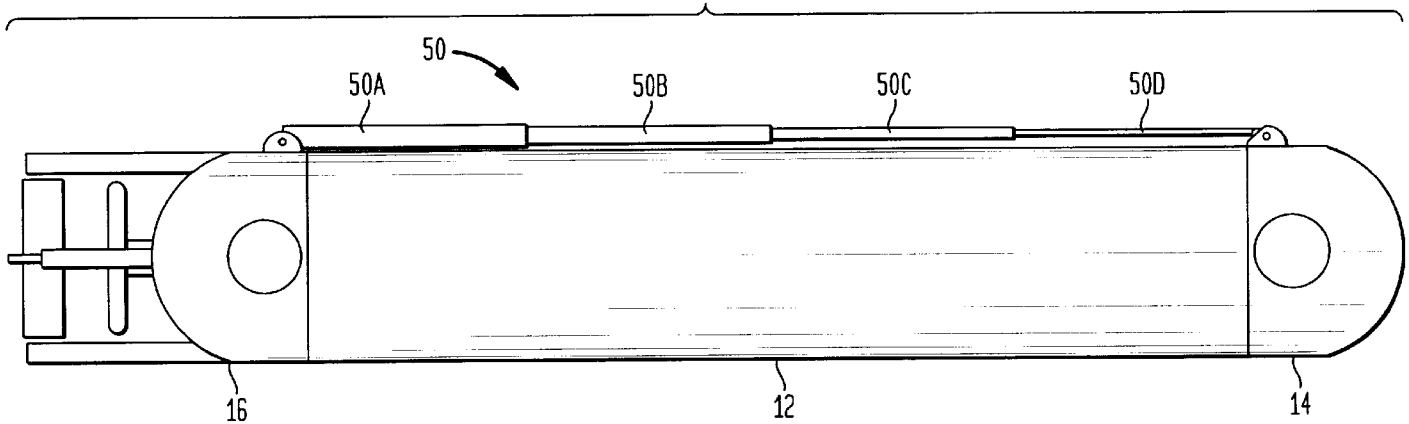
FIG. 5 is a side view of the submersible vehicle in its inflated state with an extendable boom being used to couple the nose and tail assemblies.

To facilitate storage of such a lifting boom, it may be desirable to provide an extendable or telescoping boom 50 as illustrated in FIG. 5. More specifically, boom 50 consists of extendable or telescopic sections 50A, 50B, etc., that can collapse when submersible vehicle 10 is in its collapsed state (FIG. 3). Once extended, the sections would lock together with the ends being rigidly coupled to nose assembly 14 and tail assembly 16.

Figure 6:
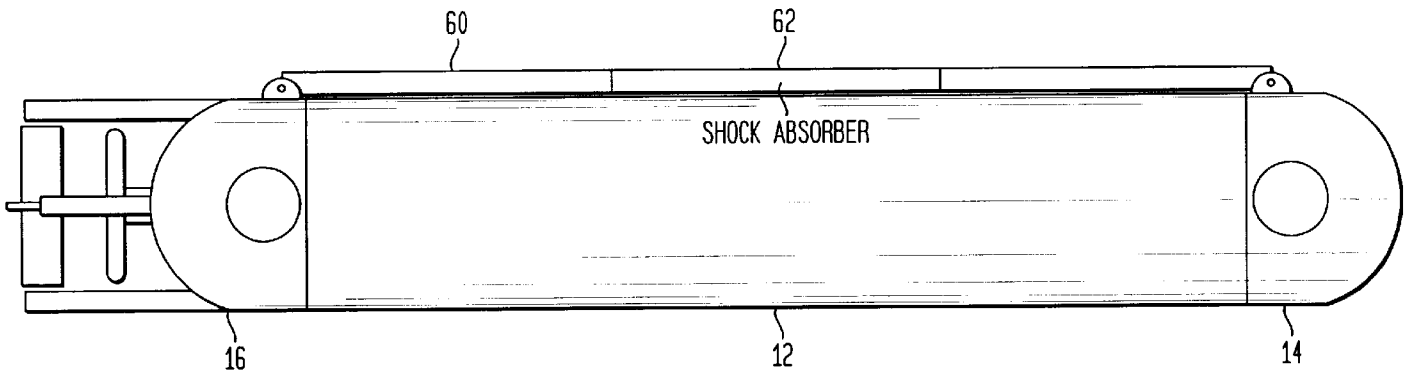
FIG. 6 is a side view of the submersible vehicle in its inflated state with a shock absorbing boom being used to couple the nose and tail assemblies.

Additionally, or alternatively, the "boom" could be one that incorporates shock absorption as illustrated by shock absorbing boom 60 in FIG. 6. As before, boom 60 is rigidly coupled to nose assembly 14 and tail assembly 16. However, rather than being locked longitudinally, a shock absorber 62 is provided in line with boom 60 so that impact forces on either nose assembly 14 or tail assembly 16 can be at least partially absorbed thereby.

Figure 7:
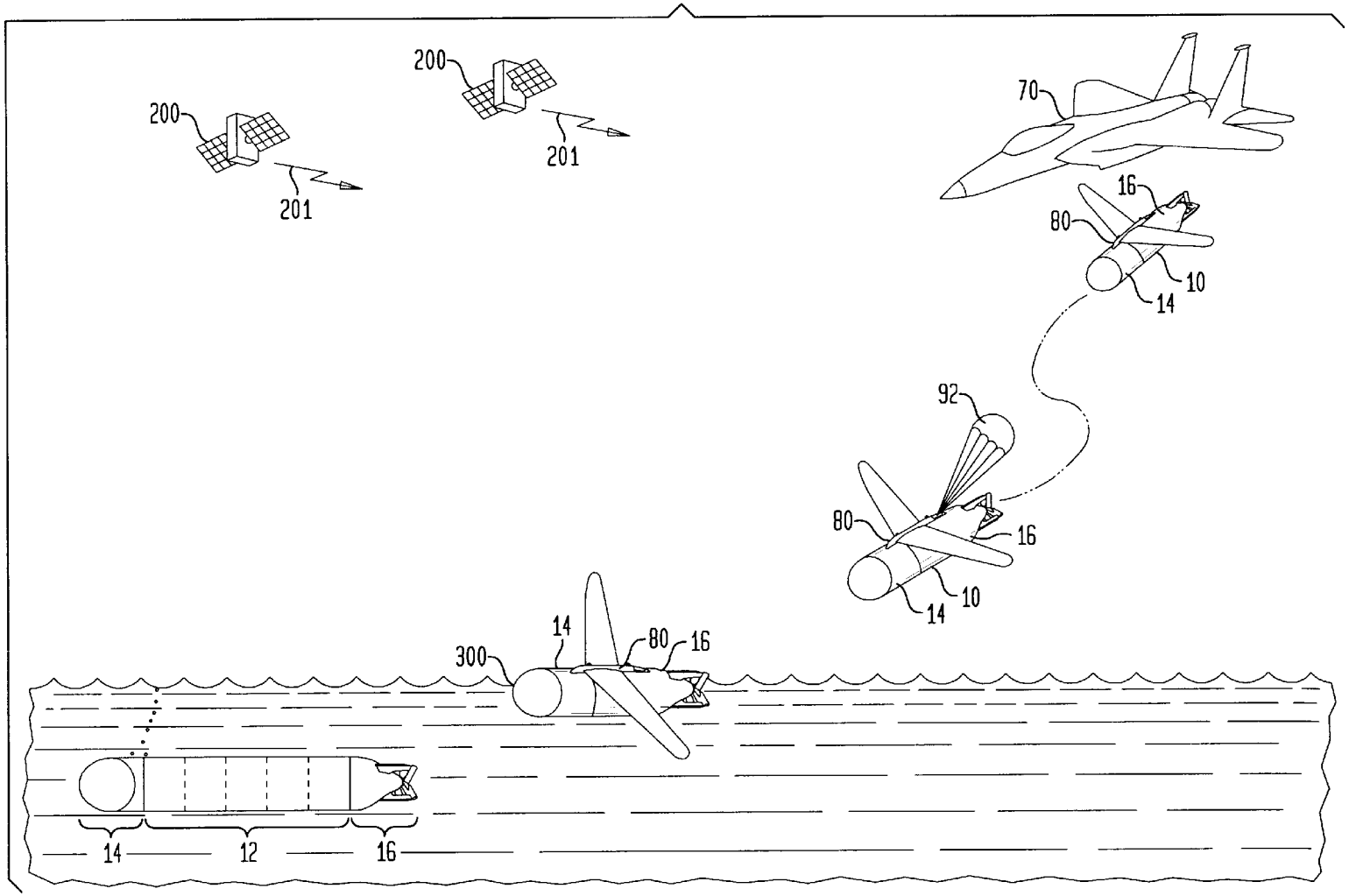
FIG. 7 depicts an operation scenario for the in-air deployment of the submersible vehicle in its deflated state.

Submersible vehicle 10 can be stowed onboard a ship in its deflated state until such time that it is needed. Alternatively, submersible vehicle 10 could be air delivered in either its deflated or inflated state (i.e., with equipment and/or personnel onboard) to a remote location. For example, FIG. 7 depicts a remote deployment sequence and operation scenario for submersible vehicle 10 in its deflated and collapsed state. A similar deployment scenario for a monocoque submersible vehicle system is disclosed in U.S. patent application Ser. No. 09/800,844, filed Mar. 8, 2001, the contents of which are hereby incorporated by reference.

In the operation scenario depicted in FIG. 7, a host vehicle 70 travels to the vicinity (e.g., a typical standoff range of 50–75 nautical miles) of an in-air deployment destination at which point submersible vehicle 10 (in its collapsed state and equipped for air travel) is released therefrom. In terms of clandestine operations, host vehicle 70 can be an aircraft (e.g., plane, helicopter, etc.) that can travel quickly to and from the vicinity of deployment without being easily detected by enemy surveillance. Once within the desired vicinity at a desired altitude and air speed, host vehicle 70 releases submersible vehicle 10 which is capable of maneuvering using GPS signals 201 originating from GPS satellites 200 orbiting the earth in ways that are well understood in the art. Submersible vehicle 10 can alternatively or additionally be equipped with an onboard inertial navigation system to supplement or back-up the GPS navigation capabilities in the event of GPS signal jamming problems.

Submersible vehicle 10 is maneuvered to a ballistic drop zone approximately above a water deployment destination referenced by numeral 300. To accomplish such navigational maneuvering of submersible vehicle 10, a glide wing assembly 80 is attached to nose assembly 14 and tail assembly 16 as shown. Once submersible vehicle 10 begins its terminal descent, a drag device such as a parachute 92 is used to slow the descent of submersible vehicle 10. After impact with the water's surface at destination 300, the entirety of glide wing assembly 80 can be removed and stored or jettisoned.

Figure 8:
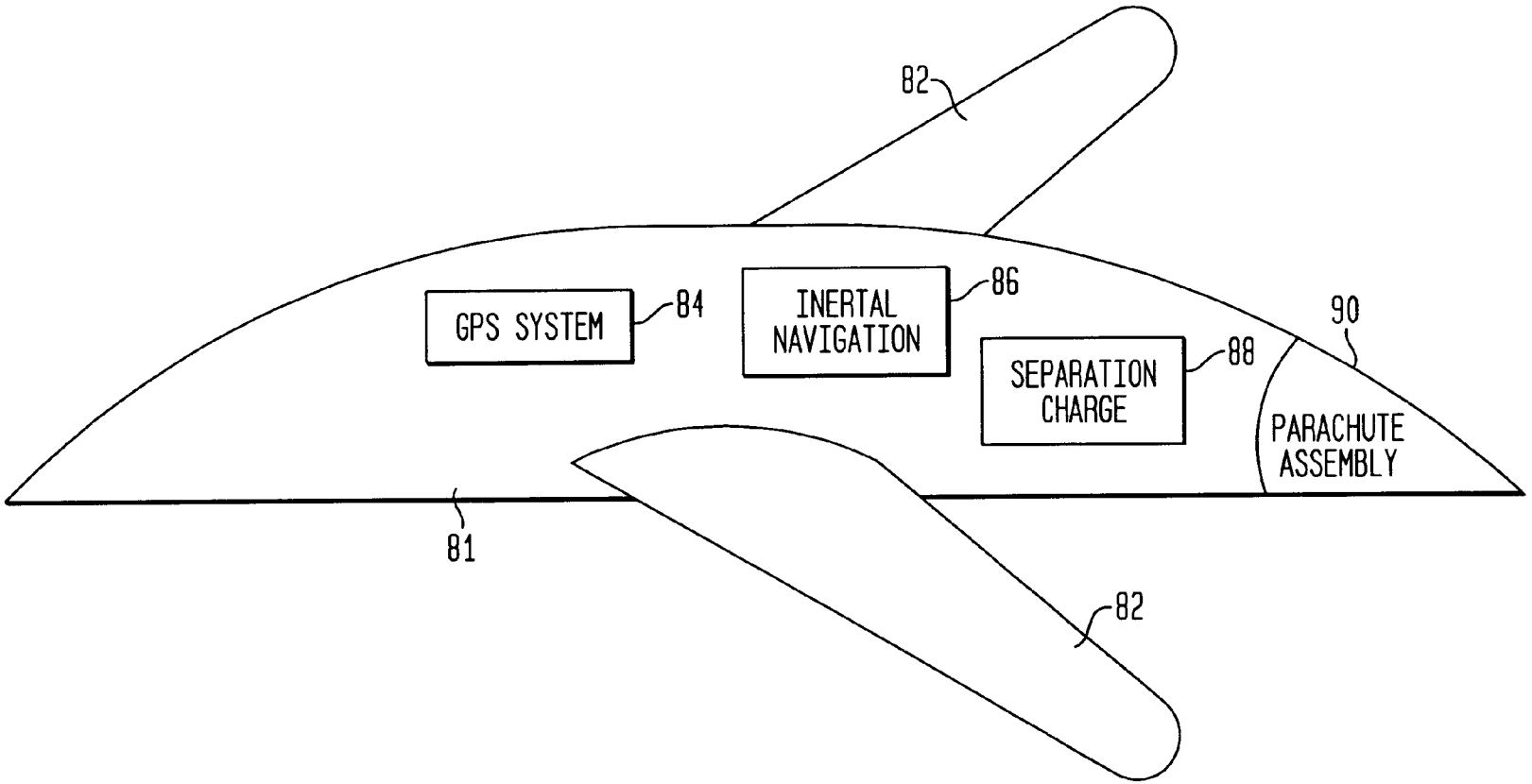
FIG. 8 is a schematic view of a wing kit used for the in-air deployment of the submersible vehicle.

One embodiment of glide wing assembly 80 is shown schematically in FIG. 8. Glide wing assembly 80 can be a wing "kit" that deploys its wings 82 to allow submersible vehicle 10 to glide and steer as a winged aircraft and then jettison (if desired) the wings at a given time or location. A variety of such wing "kits" are known in the art and are available commercially. One such commercially available system is the Longshot™ GPS Guided Wing Kit manufactured by Leigh Aero Systems, Carlsbad, California. Briefly, this wing kit includes a base 81 with wings 82 that extend therefrom once submersible vehicle 10 is free from the host aircraft. The wing kit has its own GPS system 84 for determining range and altitude. An inertial navigation system (INS) 86 can also be included as a back-up to GPS system 84. At a desired time, a separation charge 88 can be initiated to cause the combination of base 81 and wings 82 to be jettisoned. Base 81 can incorporate a parachute assembly 90 at the aft end thereof for storing a parachute (not shown in FIG. 8) that deploys (see parachute 92 in FIG. 7) from base 81. Once submersible vehicle 10 has reached its water surface destination 300, parachute 92 is jettisoned. Once in the water, nose assembly 14 and tail assembly 16 are uncoupled from one another, and hull assembly 12 is filled/pressurized with air and/or water to sink submersible vehicle 10 to its operating depth.

The advantages of the present invention are numerous. The collapsible and inflatable wet and dry submersible vehicle is lighter than existing submersibles, and can be a wet, dry, or a combination of wet and dry submersible vehicle. The reduced weight of the vehicle provides greater operational speed and range. The present invention makes use of very lightweight and very strong inflatable unibody fabrication to effect a very strong yet lightweight hull that can be produced more efficiently and consistently that in traditional welded chassis construction without the need for metals that corrode in a seawater environment. The inflatable technique results in a hull that carries its strength on the external shell of the vehicle therefore eliminating the need for heavy internal cross-sectional aluminum bulkheads and stiffeners. The unexpected benefit of this dramatic decrease in weight while maintaining structural integrity means that the hull is now light enough to be carried and flown using commercially available GPS/INS guided wing kits upon release from conventional aircraft while having a greater range than any comparably-sized rigid hull submersible. Because internal bulkheads are not required, there is more space available for passengers and equipment. An additional benefit is that such a craft would be stealthy in flight and in the water because of eliminated radar and acoustic detectable cross-section. All of the squared off surfaces in the current "machined" chassis are eliminated and replaced with rounded edges to reduce drag and increase vehicle performance. Additionally, the use of inflatable techniques allows the chassis to take on any form necessary for efficient fluid flow characteristics and internal volume maximization. The inflated hull assembly also provides a certain degree of impact absorption not found in rigid hull construction. The elimination of most metal from the hull assembly means that it is less susceptible to corrosion than most rigid hulls. Further, because the ballast tank is the hull, more internal cargo room is made available.

Although the invention has been described relative to a specific embodiment thereof, there are numerous variations and modifications that will be readily apparent to those skilled in the art in light of the above teachings. For example, rather than using rigid nose and tail assemblies, the shells of each of these assemblies could also be made of the same collapsible and inflatable construction. Also, the particular fabrics used to construct the hull assembly can be chosen from known stealth fabrics or can have a stealth coating applied thereto. Still further, the submersible vehicle could achieve air delivery through the use of a glide parachute system equipped with GPS navigation control. It is therefore to be understood that, within the scope of the appended claims, the invention may be practiced other than as specifically described.

What is claimed as new and desired to be secured by Letters Patent of the United States is:

1. A submersible vehicle, comprising:

a hull encasing a volume, said hull having a forward end and an aft end, said hull formed at least partially by an inflatable multi-wall fabric that defines a sealed space between at least two walls of said fabric;

buoyancy control means coupled to said sealed space for controlling the filling thereof with one of air, water, and a combination of air and water; and drive means coupled to said hull for propelling and steering same in the water.

2. A submersible vehicle as in claim 1 further comprising means coupled to said hull for controlling the filling of said volume with one of air, water, and a combination of air and water.

3. A submersible vehicle as in claim 1 wherein said buoyancy control means comprises:

first means coupled to said sealed space for controlling a flow of air into and out of said sealed space; and second means coupled to said sealed space for controlling a flow of water into and out of said sealed space.

4. A submersible vehicle, comprising:

a hull having a forward end and an aft end, said hull being at least partially constructed of a plurality of sections coupled together to define a volume, each of said plurality of sections defined by a compliant and inflatable multi-wall fabric that defines a sealed space between at least two walls of said fabric;

buoyancy control means coupled to said plurality of sections for individually controlling the filling of each said sealed space with one of air, water and a combination of air and water; and drive means coupled to said hull for propelling and steering same in the water.

5. A submersible vehicle as in claim 4 further comprising means coupled to at least one of said plurality of sections for controlling the filling of said volume with one of air, water, and a combination of air and water.

6. A submersible vehicle as in claim 4 wherein said buoyancy control means comprises:

first means coupled to each of said plurality of sections for controlling a flow of air into and out of said sealed space associated therewith; and second means coupled to each of said plurality of sections for controlling a flow of water into and out of said sealed space associated therewith.

7. A submersible vehicle as in claim 6 wherein said buoyancy control means further comprises third means coupled to adjoining ones of said plurality of sections for controlling a flow of one of air, water, and a combination of air and water between said sealed space associated with each of said adjoining ones.

8. A submersible vehicle as in claim 6 wherein said first means comprises:

a supply of pressurized air coupled to said sealed space for supplying said flow of air into said sealed space; and a valve coupled to said sealed space providing for said flow of air out of said sealed space to an ambient environment.

9. A submersible vehicle as in claim 6 wherein said second means comprises a pump coupling said sealed space and an ambient environment.

10. A submersible vehicle, comprising:

a collapsible hull having a forward end and an aft end, said hull being constructed of a plurality of sections coupled together to define a volume, each of said plurality of sections defined by a compliant and inflatable multi-wall fabric that defines a sealed space between at least two walls of said fabric;

buoyancy control means coupled to said plurality of sections for individually controlling the filling of each said sealed space with one of air, water and a combination of air and water;

a rigid nose assembly coupled to said forward end of said hull;

a rigid tail assembly coupled to said aft end of said hull; and means coupled to said rigid nose assembly and said rigid tail assembly for facilitating propulsion and steering of said hull having said rigid nose assembly and said rigid tail assembly coupled thereto.

11. A submersible vehicle as in claim 10 further comprising at least one bulkhead positioned in said volume for dividing said volume into a plurality of compartments.

12. A submersible vehicle as in claim 10 further comprising means coupled to at least one of said plurality of sections for controlling the filling of said volume with one of air, water, and a combination of air and water.

13. A submersible vehicle as in claim 10 wherein said buoyancy control means comprises:

first means coupled to each of said plurality of sections for controlling a flow of air into and out of said sealed space associated therewith; and second means coupled to each of said plurality of sections for controlling a flow of water into and out of said sealed space associated therewith.

14. A submersible vehicle as in claim 13 wherein said buoyancy control means further comprises third means coupled to adjoining ones of said plurality of sections for controlling a flow of one of air, water, and a combination of air and water between said sealed space associated with each of said adjoining ones.

15. A submersible vehicle as in claim 13 wherein said first means comprises:

a supply of pressurized air coupled to said sealed space for supplying said flow of air into said sealed space; and a valve coupled to said sealed space providing for said flow of air out of said sealed space to an ambient environment.

16. A submersible vehicle as in claim 13 wherein said second means comprises a pump coupling said sealed space and an ambient environment.

17. A submersible vehicle as in claim 10 further comprising a boom rigidly coupling said rigid nose assembly to said rigid tail assembly.

18. A submersible vehicle as in claim 17 wherein said boom is extensible between collapsed and extended positions.

19. A submersible vehicle as in claim 10 further comprising a boom coupling said rigid nose assembly to said rigid tail assembly, said boom incorporating means for absorbing shock forces experienced by one of said rigid nose assembly and said rigid tail assembly.

20. A submersible vehicle as in claim 10 further comprising a hatch and airlock assembly in at least one of said rigid nose assembly and said rigid tail assembly.

21. A submersible vehicle as in claim 10 further comprising a wing kit coupled to at least one of said rigid nose assembly and said rigid tail assembly for guiding said submersible vehicle through the air.

22. A submersible vehicle as in claim 21 wherein said wing kit is equipped for at least one of GPS navigation and inertial navigation.

* * * * *